United States Patent [19]

Edelmayer

[11] Patent Number: 4,788,947

[45] Date of Patent: Dec. 6, 1988

[54] CAP RETAINER FOR HYDRAULIC LASH ADJUSTER

[75] Inventor: Thomas C. Edelmayer, Ceresco, Mich.

[73] Assignee: Eaton Corporation, Cleveland, Ohio

[21] Appl. No.: 688,211

[22] Filed: Jan. 2, 1985

Related U.S. Application Data

[63] Continuation of Ser. No. 490,102, Apr. 29, 1983, abandoned.

[51] Int. Cl.[4] ..... F01L 1/24

[52] U.S. Cl. ..... 123/90.55; 123/90.46

[58] Field of Search ..... 123/90.55, 90.58, 90.52, 123/90.43, 90.46; 277/212 C, 212 FB

[56] References Cited

U.S. PATENT DOCUMENTS

| | | | |
|---|---|---|---|
| 4,098,240 | 7/1978 | Abell, Jr. | 123/90.55 |
| 4,184,464 | 1/1980 | Svihlik | 123/90.55 |
| 4,338,894 | 7/1982 | Kodama | 123/90.43 X |
| 4,387,675 | 6/1983 | Hori et al. | 123/90.55 X |

*Primary Examiner*—Ira S. Lazarus
*Assistant Examiner*—Peggy Neils
*Attorney, Agent, or Firm*—F. M. Sajovec

[57] ABSTRACT

A hydraulic lash adjuster (42) for the valve gear (14) of an internal combustion engine (12) operates from oil received under pressure from a gallery (58) provided in the engine lubricant supply system to compensate for lash in the valve train. The body (60) of the lash adjuster has a moveable plunger assembly (66) provided therein which, prior to installation in the valve gear, is retained in assembly by a retainer (120) formed of an elastic material such as nylon 6/6 including a rim portion (126) embracingly engaging the outer peripheral surface (144) of the body with equally distributed, radially directed clamping forces. The retainer also includes an end wall (122) defining a through bore (124) concentric with a shank portion (80) in the plunger assesmbly. Upon assembly, the retainer is momentarily elastically deformed to enable a bulbous end portion (74) of the plunger assembly to pass therethrough.

5 Claims, 2 Drawing Sheets

CAP RETAINER FOR HYDRAULIC LASH ADJUSTER

This is a continuation of application Ser. No. 490,102, filed Apr. 29, 1983, now abandoned.

INTRODUCTION

The present invention relates to an improved lash adjuster for use in an internal combustion engine valve gear, particularly of the hydraulic type having an overhead cam arrangement with a center pivoted rocker arm. The valve gear arrangements of this type have been found especially suited for smaller displacement, higher RPM engines.

BACKGROUND OF THE INVENTION

In relatively small displacement multi-cylinder internal combustion engines of the type having overhead valve gear, for example, 4-cylinder in-line engines, it is not uncommon for such engines to operate at high rotational speeds, for example, 4,000–6,000 RPM during a large percentage of the normal duty cycle. In this high RPM regimen, the inertial forces of the valve gear can become critical with respect to the valve spring closing force. In order to reduce the inertial forces of the valve gear, it is desirable to eliminate the push rod-type valve gear and utilize a direct-acting or cam-over-rocker arrangement. This arrangement eliminates the tappets and push rods between the camshaft and the valve rocker arms. However, in designing valve gear for a cam-over-rocker arrangement where the cam lobes contact the rocker arms directly, the usual technique, employed in push rod-type valve gear of providing lash adjustment in the tappet, is not available. Whereas, in the conventional push rod-type valve gear, the lash adjustment is usually provided in the form of a combination tappet-hydraulic valve lifter between the push rod and the camshaft. Where attempts have been made to utilize hydraulic lash adjusters for cam-overrocker valve gear, it has been found that the most compact arrangement is to provide the lash adjustment at a stationary pivot about which one end of the valve rocker is pivoted. However, where the lash adjusters operate from the pressurized engine oil, the force obtained from the oil pressure acting on the end of the adjuster plunger is increased by the mechanical leverage of the rocker and applied to the cam lobe at the rocker contact surface. This additional force results in the need for greater valve spring forces at high RPM.

Most prior art hydraulic lash adjusters are provided with a body retainer which operates to contain the plunger assembly within the body after assembly and prior to installation in a valve gear of an internal combustion engine. Typical body retainers are formed of stamped metal and have a central opening positioned over the open end of the body in register with the plunger assembly. The plunger assembly is provided with a shoulder which abuts the retainer. The body will typically include a groove on the exterior thereof and an overlying portion of the retainer is permanently plastically deformed for retention therewith.

An alternative approach has been the use of a snap or split ring action retainer which embraces the outer body surface.

Although widely commercially practiced, these approaches have a number of shortcomings. The metal retainers must be permanently deformed during assembly, a process requiring special tooling and process control to maintain acceptable tolerances. This form of mechanical attachment produces only point contact between the retainer and the body whereby the retaining forces are unequally distributed about the body. Such unequal force distribution can distort the body, imparing plunger movement and interfit within the mating head bore. Because assembly is typically affected at room temperature, the clamping forces can be lost or very substantially reduced at elevated temperatures found during normal engine operating conditions whereby the retainer can release from the body and interfere with valve train operation. Split ring type retainers likewise apply uneven clamping forces and are prone to fatigue and early catastrophic failure. A further disadvantage of the deformed metal type retainers is evident in lash adjuster designs employing a bulbous or enlarged end portion of the plunger assembly which abuts the rocker arm to reduce per unit surface loading. The deformed metal approach is wholly unacceptable for this application, leaving only the split ring approach with its above-mentioned shortcomings. A further disadvantage of prior art metal retainers arises from their physical size and the difficulty of adequately identifying a retainer prior to assembly in a lash adjuster. As is often the case, a manufacturer may produce many variations of a particular adjuster, the retainers of each which may be dimensionally distinct but visually indistinguishable. Problems arising from confusion of the identity of parts and misassembly is self-evident.

BRIEF DESCRIPTION OF THE INVENTION

The present invention provides an improved hydraulic lash adjuster including a cap retainer formed of elastic material such as nylon defining a circumferentially continuous member embracing the adjuster body for retention therewith and a through bore in nominal axial alignment with a shank portion of a lash adjuster plunger. The through bore is dimensioned smaller than a rod portion of the plunger disposed within the body bore. This arrangement has the advantage of overcoming the shortcomings of the prior art by providing an extremely inexpensive, easily identifiable (especially by color) retainer which provides uniform, equally distributed, radially directed clamping forces on the body.

In the Preferred Embodiment of the Invention, the plunger includes an end portion projecting outwardly from the body and defining a bulbous surface dimension larger than a retainer through bore. The retainer includes an end wall defining the through bore which is momentarily elastically, radially deformable to a dimension exceeding that of the bulbous surface dimension. This arrangement provides an improved retainer which provides evenly distributed retention forces but can be stretched over the bulbous end portion of the plunger during assembly of the lash adjuster and mitigates the effects of thermal expansion at normal engine operating temperatures.

According to another aspect of the invention, the through bore is dimensioned larger than the shank portion extending therethrough to maintain operating clearance therebetween or, alternatively, the through bore is dimensioned equally to or in a slight interference fit with the shank portion to create a seal therebetween. This alternative arrangement allows for horizontal orientation of the lash adjuster without fluid (oil) leakage from the body.

According to another aspect of the invention, the circumferentially continuous portion of the retainer includes a radially inwardly directed flange coacting with a complementary peripheral surface portion of the body to restrain the retainer from axial displacement. This arrangement provides increased wall section and strength and for maintained retention forces at greater tolerance mismatches between the retainer and the body.

According to another aspect of the invention, the radially inwardly directed flange is circumferentially continuous or, alternatively, is circumferentially segmented. This arrangement provides the advantage of enhanced retention or reduced weight and cost, at the option of the designer.

According to another aspect of the invention, the outer diameter of the circumferentially continuous member is slightly greater than the outer diameter of the body. This arrangement establishes a fluid seal between the lash adjuster body and the engine bore within which it resides.

According to still another aspect of the invention, the retainer is formed of injection molded nylon 6/6 or other suitable material having a characteristic tensile modulus to yield strength ratio of no more than twenty-two. This material has been found to provide a good compromise of cost and performance in most typical vehicular internal combustion engine applications.

These and other features and advantages of this invention will become apparent upon reading the following Specification which, along with the patent drawings, describes and discloses a preferred illustrative embodiment of the invention in detail.

The detailed description of the specific embodiment makes reference to the accompanying drawings.

DETAILED DESCRIPTION OF THE SPECIFIC EMBODIMENT

Figure 1:
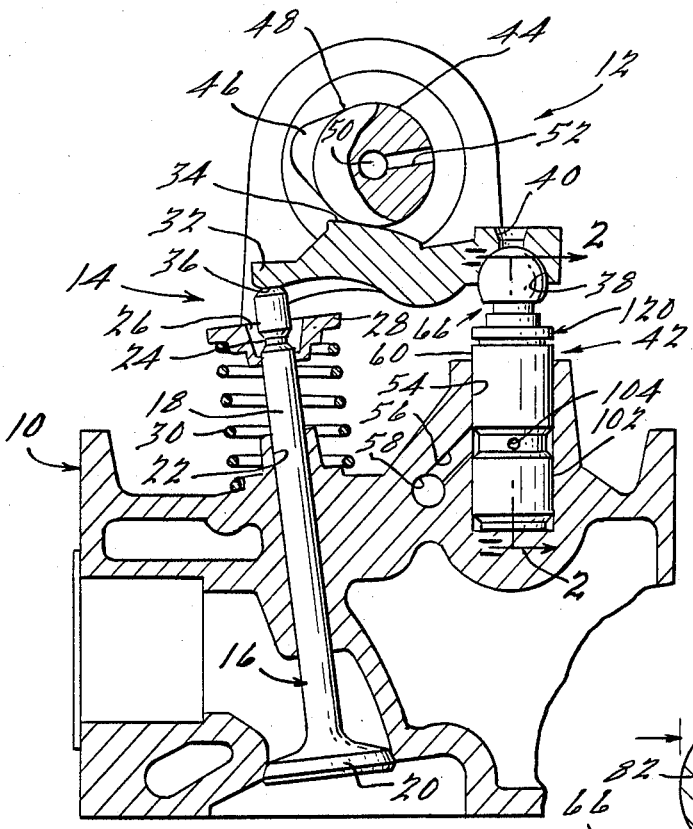
FIG. 1 is a transverse cross section through the cylinder head and camshaft of an overhead valve cam-over-rocker engine employing the valve gear of the present invention.

Referring now to FIG. 1, the present invention is illustrated in its intended environment of the cylinder head 10 of an internal combustion engine 12 including valve gear shown generally at 14 in a direct-acting or cam-over-rocker arrangement. For the sake of simplicity, only a representative portion of the total valve gear 14 is illustrated. Valve gear 14 includes a poppet valve 16 having a stem portion 18 and a head portion 20 with the stem 18 received in a valve guide 22 provided in the engine cylinder head 10. The stem 18 of the valve 16 has a groove 24 formed therein in which is engaged a peripherally split keeper 26 for retaining thereon a spring washer 28 which provides a register for a valve compression spring 30.

An overhead rocker arm 32 is provided with a cam follower pad 34 provided on one side intermediate the ends thereof and has a contact pad 36 provided on one end of the side opposite the cam follower pad 34, for contacting the end of the valve stem 18. The opposite end of the rocker arm 32 has a pivot recess 38 formed therein on the same side of the rocker arm 32 as the valve stem pad 36 with a vent means, preferably in the form of an aperture 40, or oil hole, provided therethrough to communicate with recess 38 from the opposite, or cam follower side of the rocker 32.

The end of the rocker arm 32 having pivot recess 38 formed therein is pivotally connected to a stationary pivot means in the form of a hydraulic lash adjuster 42. An engine camshaft 44 is positioned over rocker 32 and is mounted in bearings (not shown) attached to the engine cylinder head 10 in the usual manner. The camshaft 44 has a plurality of lobes 46 each having a base circle portion 48. The camshaft 44 has a central oil gallery 50 in the form of a longitudinal bore therethrough. Each cam lobe 46 has a radial oil port 52 communicating with the oil gallery 50 and extending radially outwardly to communicate with the base circle portion 48 of the cam lobe 46.

In operation, as the camshaft 44 rotates, engine oil under pressure is applied to the gallery 50 by a suitable rotary connection (not shown) communicating with the engine oil pump circuit. The oil is discharged radially outwardly from the oil ports 52 for providing lubrication of the cam lobe 46 as it contacts the pad 34 of the rocker arm 32.

It will be readily apparent that, during the majority of each revolution of the camshaft 44, the oil discharged from the radial port 52 is discharged freely outwardly into the space surrounding the camshaft 44. It will thus be apparent to those skilled in the art that a suitable cover housing (not shown) will be required to retain the free discharged oil and return the oil to the engine sump.

Referring again to FIG. 1, a suitable blind bore 54 is provided in the engine cylinder head 10 for receiving therein the lash adjuster 42. The bore 54 has communicating therewith a suitable oil port 56 which port also communicates with an oil gallery 58 provided in the cylinder head 10 of the engine 12. The oil gallery 58 is connected by suitable passages (not shown) to the engine oil pressure supply system and thus supplies engine oil under pressure to the hydraulic lash adjuster 42.

Figure 2:
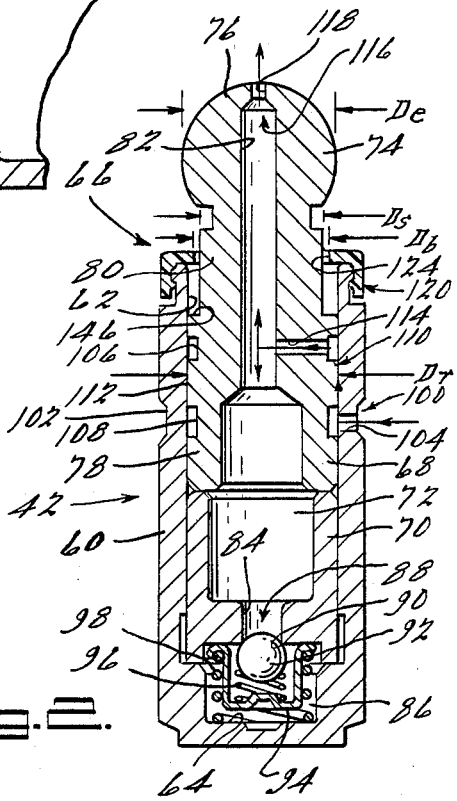
FIG. 2 is a section view taken along section indicating lines 2—2 of FIG. 1 and shows details of the stationary hydraulic lash adjuster.
Figure 3:
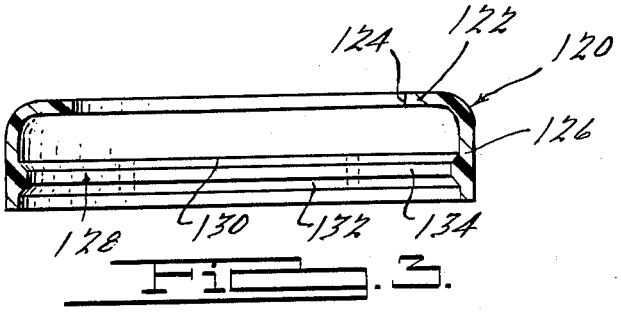
FIG. 3 is a detailed cross sectional view of a retainer employed in the lash adjuster of FIG. 2 on an enlarged scale.
Figure 4:
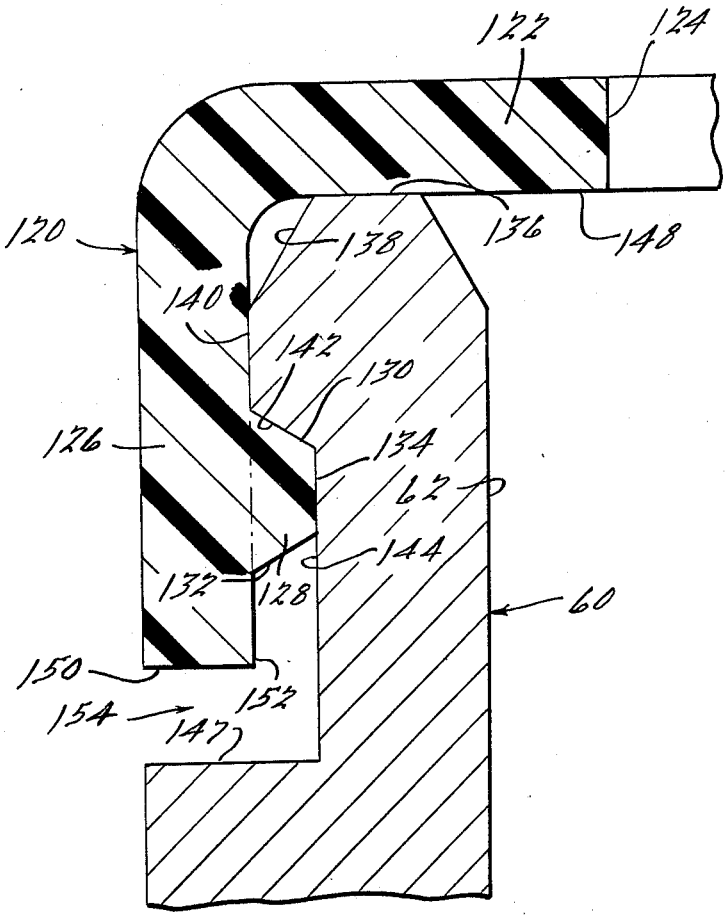
FIG. 4 is a broken enlargement of a portion of FIG. 2 illustrating the engagement between the retainer and body of the hydraulic lash adjuster.

Referring now to FIGS. 2–4, the stationary lash adjuster 42 is shown as having a body 60 preferably of cylindrical configuration with a bore 62 having a blind end 64 formed therein and with a plunger assembly 66 slidably received in the bore 62 in close fitting relationship. The plunger assembly 66 is shown in the preferred form as formed of two pieces, an upper section 68 and a lower section 70, but it will be understood that plunger assembly 66 may be made of one piece, if desired. Plunger assembly 66 is preferably made in two sections to permit enlargement of an oil passage therethrough in the region intermediate the abutting ends of upper and lower sections 68 and 70, respectively, to form a fluid reservoir 72. The upper section 68 of plunger assembly 66 has an exterior or end portion 74 extending outwardly from body 60 with end portion 74 of plunger assembly 66 having a rounded or bulbous tip 76, preferably of spherical radius provided thereon for pivotally engaging recess 38 in rocker arm 32. The end of upper section 68 opposite bulbous tip 76 comprises a cylindrical rod portion 78 having an outer diameter designated $D_r$ which slidingly interfits within bore 62. Upper section 68 of plunger assembly 66 also defines a shank portion 80 disposed intermediate rod portion 78 and end portion 74. Shank portion 80 is of a reduced substantially fixed diameter designated $D_s$ throughout the axial extent thereof. Bulbous tip 76 of end portion 74 has a maximum diameter designated $D_e$ which is substantially larger than shank diameter $D_s$. An oil passage 82 is provided longitudinally through end portion 74 of plunger assembly 66 and extends full length of upper section 68 and communicates with the outer pivot surface of bulbous tip 76. The passage 82 may, if desired, have a greater transverse dimension in rod portion 78 than the transverse dimension of passage 82 in the bulbous tip 76 in order to provide portions of reservoir 72.

The lower section 70 of plunger 66 abuts the upper section 68. The lower section 70 also has a passage 84 provided therein which extends longitudinally therethrough. Passage 84, if desired, may be enlarged in the region of abutment to provide portions of oil reservoir 72. The end of the lower section 70 of the plunger assembly 66 forms, in cooperation with the end 64 of the blind bore 62, a chamber 86 for retaining oil to maintain the plunger position for lash adjustment. A check valve 88 is provided in the end of passageway 84 of lower section 70 of plunger assembly 66 so as to permit one-way flow of oil from passage 84 through the end of the lower section 70 to chamber 86. Passages 82 and 84 each preferably have a minimum transverse dimension equal to approximately one-third the transverse dimension of the plunger.

Check valve 88 preferably has a valve seat 90 formed at the juncture of passage 84 with the end of the lower section 70 of the plunger assembly 66 and the valve 88 has a movable member 92, preferably a check ball received therein. Check ball 92 is displaceable from a closed position contacting valve seat 90 to an open position spaced therefrom. A cage 94 is received over the check ball 92 and serves to retain the ball 92 therein. A bias spring 96 is provided within cage 94 to urge check ball 92 to a closed position in contact with valve seat 90. A plunger bias spring 98 is provided in chamber 86 to register against the end of lower section 70 to urge plunger assembly 66 in a direction away from the blind end 64 of bore 62.

An oil entry port 100 is provided on the exterior of body 60. The port includes a collector groove 102 and an oil entry aperture 104 communicating collector groove 102 with bore 62 in body 60.

The upper section 68 of plunger assembly 66 has a pair of axially spaced grooves 106 and 108 disposed about the outer diameter thereof. Grooves 106 and 108 thus define, in cooperation with bore 62, a primary metering means 110 which includes an axial section of the outer diameter of rod portion 78 which section forms a metering land 112. It will be apparent to those skilled in the art that collector grooves 106 and 108 are so located on plunger assembly 66 such that, during the movement of plunger assembly 66 between its predetermined limits of lash adjustment, the lower collector groove 108 will, at all times, receive oil from the entry port 100. The upper collector groove 106 has a passage in the form of a cross hole 114 provided therein which communicates the upper collector groove 106 with the interior passage 82 in the upper section 68 of plunger assembly 66. Thus, oil entering the oil entry port 100 passes through the primary metering means 110, along the metering land 112 to the upper collector groove 106, then through cross hole 114 to the oil reservoir in the interior bore 82, 84 forming the reservoir 72 in plunger assembly 66. The path of the metered oil is shown in FIG. 2 by the heavy black line with arrowheads indicating the direction of metered flow.

The arrangement of the collector groove 102, oil entry aperture 104, and the cooperating collector grooves 106 and 108 in plunger assembly 66 as shown in the embodiment of FIG. 2 provides the metering land 112 having a preferable constant length not dependent upon the position of the plunger assembly 66 in the bore 62 of the adjuster body 60. This arrangement thus provides a constant length metering land as is known in the art, see for example, U.S. Pat. Nos. 3,448,730 and 4,098,240 to Roy F. Abell, Jr. In the present practice of the invention, plunger movement, in the amount of 0.150 to 0.200 inches are permitted for lash adjustment and for which movement the metering land 112 is maintained constant.

It will be apparent to those having ordinary skill in the art, that the adjacent abutting surfaces of the upper plunger section 68 and lower plunger section 70 must be designed so to effectively provide a seal and prevent leakage of oil therethrough, thereby preventing an alternate bypass or shunt, flow of lubricant other than through the primary metering means having land 112.

In order to provide sufficient lubricant fluid flow across the check valve at high RPM and to prevent consequent malfunction of the lash adjuster 42, it has been found necessary to maintain the fluid pressure reservoir 72 at pressures slightly above atmospheric. The present invention provides this pressure control by secondarily metering fluid flow from the reservoir 72 through passage 82 in the upper plunger section 68, as it leaves passage 82, by a secondary metering means 116, preferably in the form of a restricting orifice 118. The presently preferred lash adjuster 42 of the valve gear 14 thus employs a primary metering means 110 and a secondary metering means 116 in tandem, or fluidically in series, with the fluid reservoir 72 and bulbous tip surface 76. For proper metering, the primary and secondary metering means 110 and 116, respectively, are chosen such that the pressure drop $\Delta P_{110}$ across the primary metering means 110 is greater than the pressure drop $\Delta P_{116}$ across the secondary metering means 116. In the present practice of the invention, it has been found for cold oil starts with oil entering port 100 at 100 psi (34.4 $Kg/cm^2$) and using a primary metering land of 0.100 inches (2.54 mm) length with about 0.0021 inches (0.050 mm) clearance for a 0.60 inch (15.2 mm) diameter plunger and restricting orifice 118 of 0.015 inches (0.32 mm) diameter gives a pressure of 10.5 psi in reservoir 72.

In operation, as the base circle portion 48 of the camshaft 44 rotates to a position in contact with the pad 34 on rocker arm 32, the plunger bias spring 98 urges the plunger assembly 66 away from the bore end 64 so that the rounded tip 76 moves the rocker 32 to contact and urge the recess 38 in the rocker 32 upwardly until the pad 34 is forced to contact the base circle portion 48 of the camshaft 44. As the cam lobe 46 contacts the pad 34 of rocker arm 32 and asserts a force on the pivoted end of the rocker arm 32, both of the plunger sections, 68 and 70 are forced downward together as a unit in a manner tending to compress the oil trapped in chamber 86. The check valve 88 prevents unwanted flow of oil from the chamber 86 and thus prevents further downward movement of the plunger sections, shortening of the adjuster 42 and thus prevents further movement of the rocker pivot.

Referring to all of the drawing figures and particularly to FIGS. 3 and 4, an annular plunger retainer 120 is provided to retain plunger assembly 66 within bore 62 of body 60 against the bias force of spring 98, when no load is present on the plunger assembly 66. Retainer 120 is principally intended to ensure plunger retention prior to installation of the lash adjuster 42 within valve gear 14. After installation, the downward force applied by rocker arm 32 upon bulbous tip 76 of plunger assembly 66 serves to retain lash adjuster 42 in assembly. However, it is important for plunger retainer 120 to remain in its intended position throughout the life of the lash adjuster 42 should it be required during subsequent servicing, inspection or the like.

In its preferred embodiment, plunger retainer 120 is injection molded of nylon 6/6 or other suitable material with a tensile modulus to yield strength ratio of no more than twenty-two. This limitation is dictated by tolerances and materials normally found in valve gear of passenger vehicles and may vary in different applications. Accordingly, in its broadest sense, the present invention is intended to cover other materials, principally plastics such as acetal in formulating plunger retainer 120.

Retainer 120 includes an annular end wall portion 122 defining a through bore 124 at the radially innermost portion thereof. A skirt 126 circumscribes the outer periphery of wall portion 122 and integrally depends therefrom. Throughbore 124 has a diameter designated $D_b$ (refer FIG. 2). A circumferentially continuous radially inwardly directed rib or flange 128 depends inwardly from skirt 126 at an intermediate point therealong. Rib 128, alternatively, (as shown in phantom in FIGS. 3 and 4) can be circumferentially segmented into two or more distinct segments or rib portions 129 interspaced by gaps indicated generally at 131. Rib 128 defines acutely angled upper and lower surface portions 130 and 132, respectively and a radially inwardly facing vertical intermediate wall portion 134 therebetween. The uppermost end of body 60 of lash adjuster 42 forming the opening of bore 62 defines an area of reduced section shaped complementarily with the lowermost surface 148 of annular end wall portion 122 and the radially innermost surfaces of skirt 126 and rib 128. The uppermost part of body 60 defines a generally horizontal surface 136 which abuts the lowermost surface of annular end wall portion 122 about the periphery thereof. Body 60 further defines an acutely outwardly angled ramp surface 138, an intermediate vertical surface 140 and an acutely inwardly directed ramp surface 142.

The outer peripheral surface of skirt 126 of retainer 120 is dimensioned to form a line to lint slight interference fit with the cylinder head bore 54 (see FIG. 4) within which it resides in valve train arrangements such as conventional reciprocating lifter types to effect a dynamic seal between the adjuster body and the head.

During assembly of lash adjuster 42, plunger assembly 66 is assembled and inserted within bore 62 as illustrated in FIG. 2. As a final assembly operation, retainer 120 is installed by positioning it concentrically above bulbous tip 76 and directing it downwardly thereover whereby the portion of end wall 122 forming through bore 124 circumferentially contacts bulbous tip 76 and is radially stretched or locally deformed outwardly thereby to momentarily increase to an effective diameter at least equaling $D_e$. As retainer 120 is displaced further downwardly into alignment with shank portion 80, through bore 124 regains its nominal diameter $D_b$. As insertion continues, lower wall portion 132 of retainer 120 will contact ramp surface 138 of body 60.

As wall portion 132 first contacts ramp surface 138, it establishes a line contact therebetween to center through bore 124 concentrically with shank portion 80 to ensure the maintenance of substantially uniform clearance therebetween of a dimension $(D_b-D_s)/2$. This nominal axial alignment is maintained with plunger assembly 66 in any position because shank portion 80 is of a substantially fixed diameter. As insertion continues, ramp surface 138 will stretch skirt 126 and rib 128 locally radially outwardly until surface 134 of retainer 120 is radially coextensive with surface 140 of body 60. As insertion continues, upper wall portion 130 of rib 128 will engage ramp surface 142. The elastically resilient nature of the material forming skirt 126 will cause skirt 126 to constrict thereby drawing rib 128 radially inwardly and simultaneously placing surface 136 of body 60 into abutment with the lower surface of 148 end wall portion 122. Simultaneously, intermediate wall portion 134 will abut vertical surface 144 of body 60 to complete the assembly of lash adjuster 42. The close complementary interfit between retainer 120 and body 60 ensures adequate retention under all normal operating conditions while minimizing the volume of the material selected for retainer 120. As should now be evident, a step 146 defined by the transition between shank portion 80 and rod portion 78 of plunger assembly 66 will abut the lowermost surface 148 of end wall portion 122 to define an outward or upward (as viewed in FIG. 2) limit of travel of plunger assembly 66. At the lowermost extent of vertical surface 144, body 60 has a step transition to its nominal increased wall thickness, forming a shoulder 147 at a point spaced from the lowermost surface 150 of skirt 126. An open area between step 147 and lower surface 150 as well as a radially spaced area between a vertical radially inwardmost surface 152 beneath rib 128 and surface 144 of body 60, define a tool receiving recess designated 154. A tool of appropriate dimension and shape, such as a screwdriver, can be inserted within tool receiving recess 154 and, by prying action, locally displaces a portion of skirt 126 radially outwardly until surface 134 of rib 128 is radially outwardly coextensive with surface 140 of body 60 to release and remove retainer 120 from lash adjuster 42 in an opposite manner to that described hereinabove relating to its installation. Such removal is accomplished without damaging or unduly fatiguing the material of retainer 120 to permit inspection, maintenance or the like of lash adjuster 42. Such removal and reuse of prior art plastically deformed metal retainers are not practical inasmuch as elaborate metalforming tooling are required, and the reinstalled metal retainer has questionable structural integrity.

Although the illustrated preferred embodiment of the invention provides a through bore 124 diameter in excess of the shank portion 80 outer diameter to maintain a clearance therebetween during operation of lash adjuster 42 within valve gear 14, an alternative embodiment of the present invention provides for sealing of bore 62 by dimensioning through bore 124 equal to or slightly less than shank portion 80 outer diameter to effect a seal therebetween as illustrated by alternative shank 80' shown in phantom in FIG. 4. This bore sealing feature is especially important in applications where lash adjuster 42 is oriented horizontally to prevent fluid leakage from within body 60.

A further modification of the present invention would entail locally increasing the wall thickness of body 60 at an axial location corresponding with lower wall portion 132 of retainer 120 to establish an abutting surface therewith. Such an abutting relationship will serve to prevent relative axial displacement between body 60 and retainer 120 without reliance on the abutting relationship between surfaces 136 and 148 of body 60 and retainer 120, respectively.

The materials described hereinabove for use in retainer 120 also can be injection molded in any number of distinct colors making retainer designs which are dimensionally different but otherwise visually indistinguishable, readily identifiable.

Definitionally, by "elastically yieldable material", the applicant means material that can be momentarily stretched or locally deformed to effect a dimensional increase to allow assembly and then return to its original dimension by virtue of the materials' own resiliency and retaining its original material properties, without fatiguing, work hardening, or the like.

It is to be understood that the invention has been described with reference to specific embodiments which provide the features and advantages previously described, and that such specific embodiments are susceptible to modification, as will be apparent to those skilled in the art. For example, the selection of a material different than that disclosed as the preferred material will entail a different optimum characteristic tensile modulus to yield strength ratio. Furthermore, although round bores are preferred, the present invention is contemplated as covering other shapes. Although disclosed in a cam-over-rocker arm arrangement, it is contemplated that, in its broadest sense, the present invention could be applied in a conventional reciprocating lifter such as the disclosed in U.S. Pat. Nos. 4,367,701 and 4,373477. Accordingly, the foregoing description is not to be construed in a limiting sense.

What is claimed is:

1. A hydraulic lash adjuster of the valve gear of an internal combustion engine comprising:

a generally cylindrical body defining an outwardly opening blind bore oriented along the longitudinal axis thereof;

a plunger assembly including a rod portion slidable received in said bore, an end portion extending outwardly from said body, and a shank portion disposed intermediate said rod and end portions, said rod and shank portions having characteristic nominal diameters of $D_r$ and $D_s$, respectively, said end portion defining a bulbous tipped pivot surface adapted to contact associated engine valve gear components and, having a maximum diameter of $D_e$, wherein $D_r$ and $D_e$ substantially exceed $D_s$, said plunger assembly defining, in cooperation with the blind end of said bore, a cavity, said plunger assembly including means defining a fluid reservoir and one-way valve means permitting fluid flow from said reservoir to said cavity, said body including port means adapted for receiving fluid under pressure therein, said body and plunger assembly coating to define a fluid passage communicating with said port means and providing exclusive fluid communication therefrom with said reservoir, said passage defining means including a fluid metering means defining a substantially constant length annular metering orifice between said rod portion and said body bore for continuously metering said fluid flow into said fluid reservoir, said annular metering orifice being effective for causing a substantial pressure drop thereacross, said plunger assembly further including means defining a second fluid passage and providing exclusive fluid communication from said reservoir means to said pivot surface, said second passage defining means including second fluid metering means comprising a metering orifice, said metering orifice providing continuous fluid communication to said pivot surface being sized for maintaining said fluid pressure in said fluid reservoir above atmospheric pressure; and means integrally formed of an elastically yieldable nylon material having a characteristic tensile modulus to yield strength ratio not exceeding twenty-two for retaining said plunger assembly within said body prior to installation within said valve gear, said retainer means including a circumferentially continuous skirt portion embracing said body through complementary conforming surfaces at a location adjacent said bore opening to apply substantially uniform, equally distributed, radially directed clamping forces thereupon to restrain said retainer and body form relative axial displacement, and end wall defining a through bore having a characteristic nominal diameter $D_b$ disposed concentrically with said body bore and in nominal axial alignment with said shank portion, wherein $D_b$ is less than $D_r$ and $D_e$, said skirt including a radially inwardly directed circumferentially continuous flange defining at least one of said complementarily conforming surfaces, said skirt and adjacent body portions coacting to define a tool receiving recess therebetween, and said retainer means being formed of a material characterized by preselectably optically sensible indicia.

2. An hydraulic lash adjusting means for the valve gear of an internal combustion engine comprising:

a body defining a bore;

plunger means including a rod portion slidably received in said bore, an end portion extending outwardly from said body, a shank portion disposed intermediate said rod and end portions, said end portion having a bulbous tip with the diameter thereof larger than said shank; and means for retaining said plunger means in assembly with said body prior to installation within said valve gear, said retainer means defining a member having an aperture elastically received over said bulbous portion, and defining a pivot surface adapted for pivotal contact with associated engine valve gear components, said aperture in sliding arrangement with said shank portion, said retaining means member formed of plastic material having the ratio of tensile modulus to yield strength not greater than twenty two (22) and having integral portions thereof positively engaging in snap-locking arrangement said body for retention thereon and other portions thereof for providing a limit stop for said plunger means, wherein said lash adjusting means includes a high pressure chamber between said base and said plunger means, one-way valve means supplying said chamber.

3. The hydraulic lash adjusting means defined in claim 2, wherein said member is an annular member having said other portions comprising a radially inwardly extending flange.

4. The hydraulic lash adjusting means defined in claim 2, wherein said retaining means is formed of nylon 6/6 material.

5. The lash adjusting means defined in claim 2, wherein said bulbous portion defines a fluid metering orifice for supplying fluid to said pivot surface.

* * * * *